US007214036B2

(12) United States Patent
Yoshimura

(10) Patent No.: US 7,214,036 B2
(45) Date of Patent: May 8, 2007

(54) SCREW TYPE VACUUM PUMP

(75) Inventor: Masashi Yoshimura, Yamaguchi (JP)

(73) Assignee: Taiko Kikai Industries Co., Ltd., Yamaguchi (JP)

( * ) Notice: Subject to any disclaimer, the term of this patent is extended or adjusted under 35 U.S.C. 154(b) by 508 days.

(21) Appl. No.: 10/490,956

(22) PCT Filed: Dec. 14, 2001

(86) PCT No.: PCT/JP01/10985

§ 371 (c)(1),
(2), (4) Date: Mar. 26, 2004

(87) PCT Pub. No.: WO03/031821

PCT Pub. Date: Apr. 17, 2003

(65) Prior Publication Data

US 2004/0247465 A1 Dec. 9, 2004

(30) Foreign Application Priority Data

Sep. 27, 2001 (JP) ..... 2001-296872

(51) Int. Cl.
*F04B 25/00* (2006.01)

(52) U.S. Cl. ..... 417/252; 417/310; 417/308; 418/201.1; 418/201.3

(58) Field of Classification Search ..... 418/201.1, 418/201.3; 417/251, 252, 308, 310
See application file for complete search history.

(56) References Cited

U.S. PATENT DOCUMENTS

| | | | | |
|---|---|---|---|---|
| 3,947,163 | A * | 3/1976 | Olofsson | 418/203 |
| 4,983,107 | A * | 1/1991 | Steffens et al. | 418/9 |
| 5,549,463 | A * | 8/1996 | Ozawa | 418/3 |
| 5,667,370 | A * | 9/1997 | Im | 418/9 |
| 6,375,443 | B1 * | 4/2002 | Yoshimura | 418/84 |
| 7,140,846 | B2 * | 11/2006 | Yamamoto et al. | 417/245 |

FOREIGN PATENT DOCUMENTS

| | | |
|---|---|---|
| JP | 3-111690 | 5/1991 |
| JP | 2000-136787 | 5/2000 |

* cited by examiner

*Primary Examiner*—Michael Koczo, Jr.
*Assistant Examiner*—Vikansha Dwivedi
(74) *Attorney, Agent, or Firm*—Finnegan, Henderson, Farabow, Garrett & Dunner, L.L.P.

(57) ABSTRACT

A screw vacuum pump which allows reduced power, lower inside gas temperature, and reduced discharging time. The pump has a pair of screw rotors rotatively engaged with each other in a pump casing to discharge a gas along a longitudinal direction of the pump. Each rotor has three types of helical teeth serially located in a longitudinal direction of the rotor and different from each other in theoretical displacement volume. A bypass conduit communicating with a delivery side of the pump is connected via a first check valve to a first intermediate space defined between the first helical teeth and the second helical teeth and via a second check valve to a second intermediate space defined between the second helical teeth and the third helical teeth. The gas is compressed at the third stage to half the first stage volume before a discharge port opens.

14 Claims, 4 Drawing Sheets

SCREW TYPE VACUUM PUMP

FIELD OF THE INVENTION

The present invention relates to a screw vacuum pump having a pair of multiple-stage-screw rotors to compress a gas sequentially with a plurality of steps.

BACKGROUND OF THE INVENTION

Recently, it has been desired that a vacuum pump requires a smaller energy (electrical power) to reduce $CO_2$ emission in view of an environmental control. In Europe (EC), a chemical gas vacuum pump needs to have a discharge side temperature not more than 135° C. according to a safety standard. The temperature corresponds to a temperature grade T4 of the standard, in which acetaldehyde, trimethylamine, ethyl-methyl-ether, diethyl-ether, etc. are listed. These materials need to have a gas temperature not more than 135° C. at an outer surface thereof.

A conventional screw vacuum pump is disclosed in Japanese Patent Application Laid-open No. 63-36085, which is a single-stage pump having a pair of screw rotors. Another conventional screw vacuum pump is shown in FIG. 5, which is a two-stage pump having a pair of screw rotors.

This vacuum pump 61 has a pair of left and right screw rotors 63, 64 rotatively engaged with each other in a casing 62. The screw rotor 63 rotates clockwise while the screw rotor 64 rotates counterclockwise. Each of the rotors 63, 64 has helical teeth 65, 66 being different from each other in pitch. The helical tooth 65 has a larger pitch and is located in the side of a suction port 67 defined in the casing 62, while the helical tooth 66 having a smaller pitch is located in the side of a delivery port (not shown) of the casing 62.

Each of the screw rotors 63, 64 is supported at each axial end thereof by a bearing 73 or 68. The screw rotors 63, 64 can rotate adversely relative to each other via a timing gear 69 located at one end of thereof. A rotor shaft 70 couples operatively to a drive motor.

The rotation of the screw rotors 63, 64 compresses a gas introduced into a chamber 71 located in the side of the first helical teeth 65 from the suction port 67. The compressed gas is transferred into a chamber 72 of the second helical teeth 66, and the gas is further compressed in the chamber 72 to discharge it from the delivery port under an atmospheric pressure.

However, the conventional vacuum pump 61, as illustrated in a characteristic curve of FIG. 6, requires a comparatively larger power (shat driving power La), which disadvantageously increases a delivery gas temperature more than 200° C. In FIG. 6, a lower graph shows a shaft driving power (kW) while an upper graph shows a discharge gas flow rate (1/minute). Horizontal coordinates correspond to vacuum degrees (MPaA). Moreover, the gas compressed via the two stages tends to cause a considerable pressure loss due to a gas leak through a gap between the pair of screw rotors 63, 64. This undesirably decreases a discharge gas flow rate S as shown in an upper one of graphs of FIG. 6.

Screw vacuum pumps having such a property not only require a larger motor power but also compress a gas undesirably to create a gas temperature more than 135° C. Particularly, the screw vacuum pumps take a longer discharging time when a gas is compressed from a vacuum to an atmospheric pressure, which is an undesirable performance of them.

In view of the aforementioned situation, an object of the invention is to provide a vacuum pump requiring a reduced power and enhancing a reduced $CO_2$ emission. The vacuum pump has an inside gas temperature (a temperature in a delivery side) that fulfills an EN standard (not more than 135° C.). The vacuum pump is improved in safety and its gas delivery performance.

SUMMARY OF THE INVENTION

To achieve the object, a screw vacuum pump of claim 1 of the invention includes a pair of screw rotors rotatively engaged with each other in a pump casing to discharge a gas along a longitudinal direction of the pump. Each rotor has across section with a profile including an epitrochoid curve, a circular arc, and a pseudo-Archimedean spiral curve. Characteristically, each rotor has three types of helical teeth serially located in a longitudinal direction of the rotor, the three types of helical teeth being different from each other in theoretical displacement volume. A bypass conduit communicating with a delivery side of the pump is connected via a check valve to a first intermediate space defined between the first helical teeth and the second helical teeth and to a second intermediate space defined between the second helical teeth and the third helical teeth.

In thus configured pump, a gas introduced in the pump casing is compressed at a first stage by the first type of helical teeth, in which a part of the gas is discharged into the bypass conduit via a check valve when the pressure of the gas becomes more than a predetermined value (for example, an atmospheric pressure). The remaining gas is further compressed at a second stage by the second type helical teeth, in which a part of the gas is discharged into the bypass conduit via a check valve when the pressure of the gas becomes more than a predetermined value as well as the first stage. The remaining gas is further compressed at a third stage by the third helical teeth to be discharged outside the pump. Each check valve prevents a gas flow returning from the bypass conduit.

This configuration protects the screw rotors not to be under a larger load otherwise exerted during the first to third stages, limiting a temperature increase of the compressed gas. The gas discharges from a port between the first stage and the second stage, a port between the second stage and the third stage, and a discharge outlet of the third stage. Thus, the gas discharge speed is substantially uniform in the first to third stages, decreasing a total time for discharging the gas.

A screw vacuum pump of claim 2 is one described in claim 1, and the screw pump is further characterized in that the three types of helical teeth provides a ratio of 1.4 of a gas flow rate at the first stage to that at the second stage, a ratio of 1.4 of a gas flow rate at the second stage to that at the third stage, and a ratio of 2 of a gas flow rate at the first stage to that at the third stage.

In the above-mentioned configuration, a pressure ratio of delivery pressure Pd to suction pressure Ps is equal to 2. When Pd is 760 Torr, Ps is a half of Pd, which is 380 Torr. Meanwhile, a discharge gas temperature Td is equal to Ts $(Pd/Ps)^{n-1/n}$, where Ts designates a suction gas temperature. When politropic exponent n is 1.6, Td is about 106° C., which is lower than 135° C. to sufficiently fulfill the EN standard.

A screw vacuum pump of claim 3 is one described in claim 1 or 2. The pump is further characterized in that the gas is compressed at the third stage into about a half in quantity to the first stage before a discharge port opens to discharge the gas. This configuration surely achieves a gas flow ratio (approximately 2) of the first stage to the third stage.

BRIEF DESCRIPTIONS OF ACCOMPANIED DRAWINGS

BEST MODE EMBODYING THE INVENTION

Referring to the accompanied drawings, an embodiment of the present invention will be discussed.

Figure 1:
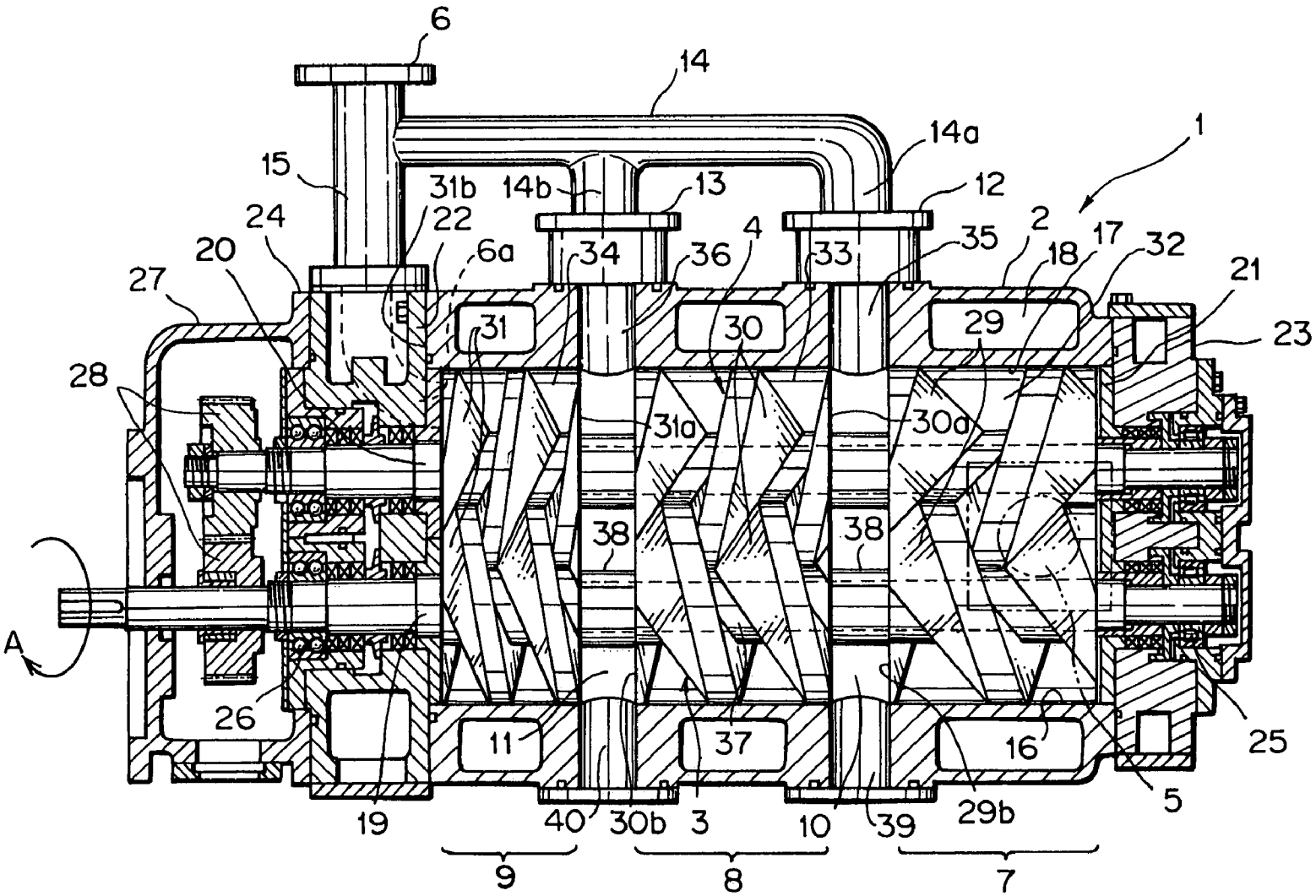
FIG. 1 is a longitudinal sectional view showing an embodiment of a screw vacuum pump according to the present invention.

FIG. 1 shows an embodiment of a screw vacuum pump, more definitely of a screw-type dry vacuum pump, according to the present invention.

The vacuum pump 1 has a metal casing 2 in which there are a pair of screw rotors 3, 4. The screw rotor 3 has a clockwise helical screw while the screw rotor 4 has a counterclockwise helical screw such that the screws rotatively engage with each other. Each of the screws of the rotors 3, 4 has three types of pitches serially in its longitudinal direction. This provides first to third compression stages 7, 8, and 9 between a suction port 5 and a discharge outlet 6 within the casing 2. More specifically, an intermediate space 10 defined between the first stage 7 and the second stage 8 communicates via a check valve 12 with a pipe conduit (bypass pipe) 14 located outside the casing. Furthermore, an intermediate space 11 defined between the second stage 8 and the third stage 9 communicates via a check valve 13 with the pipe conduit 14. The pipe conduit 14 communicates with a pipe 15 disposed in the side of the outlet 6.

The casing 2 has a substantially elliptical profile and includes two rotor chambers 16, 17 that have a generally spectacle-shaped cross section consisting of two circles partially overlapped with each other. The casing 2 has a cooling (water cooling) jacket 18 outside thereof. The parallel rotor chambers 16 and 17 rotatively accommodate the pair of left and right screw rotors 3 and 4. Each rotor has an outer peripheral surface positioned adjacent to an inner surface of the rotor chamber 16 or 17 with a little clearance therebetween. The screw rotors 3 and 4 also are positioned adjacent to each other with a small gap therebetween.

The screw rotor 3 or 4 has a shaft 19 or 20 which penetrates through a partition wall 21 or 22 positioned at a longitudinally fore or rear side of the casing 2. The shaft 19 or 20 is rotatively supported by a bearing 25 or 26 within a side case 23 or 24. The shaft 19 or 20 is secured to the rotor 3 or 4 with a key or the like. The discharge outlet 6 communicates with a discharge port 6*a* in the side of the partition wall 22.

The side case 23 located in the side of the suction port 5 receives a pair of roller bearings 25 secured therein, while the side case 24 located in the side of the discharge outlet 6 receives a pair of ball bearings 26 secured therein. The pump has an end cover 27 in which there are disposed a pair of timing gears 28. Each of the shafts 19, 20 is sealed by a sealing member in the side of the partition wall 22 to keep air tightness. The timing gears 28 engage with each other so that the shafts 19 and 20 can rotate oppositely to each other.

One 19 of the shafts extends from the end cover 27 to be coupled to a motor (not shown) via a coupler. The turning of the motor rotates the rotor 3 located in the driving side clockwise as shown by an arrowhead A so that the rotor 4 located in a follower side rotates counterclockwise.

Each rotor 3 or 4 has a larger helical screw pitch in the side of the suction port 5 and a smaller helical screw pitch in the side of the discharge outlet 6. Meanwhile, the screw rotor has an intermediate-size helical screw pitch in a longitudinally intermediate part thereof between the suction port 5 and the discharge outlet 6. The first stage 7 is defied in the side of the suction port 5 by the first type helical teeth 29 having the larger pitch; the second stage 8 is defined in the intermediate part by the second type helical teeth 30 having the intermediate size pitch; and the third stage 9 is defined in the side of the discharge outlet 6 by the third type helical teeth 31 having the smaller size pitch.

In the embodiment, the rotor chamber 32 of the first stage 7 has a length axially equal to or a little longer than the rotor chamber 33 of the second stage 8, while the rotor chamber 34 of the third stage 9 has a length shorter than that of the rotor chamber 33 of the second stage 8.

The suction port 5 is positioned at the first winding of the helical tooth 29 of the first stage 7 to communicate with the rotor chamber 32, while the discharge port 6*a* of the discharge outlet 6 is positioned in a fore end surface 31*b* of the helical tooth 31 of the third stage 9 to communicate with the rotor chamber 34. The port 6*a* is connected to the outside of the pump via the pipe 15. With the rotation of the 4, the end surface 31*b* of the helical tooth 31 closes and opens alternately the discharge port 6*a*. The discharge port 6*a* has, for example, a crescent shape. The crescent may be defined by a smaller radius inner arc, a larger radius outer arc, and a line to connect one end of the inner arc and one end of the outer arc, the other ends of the inner and outer arcs being crossed with each other.

The discharge pipe 15 merges with the pipe conduit 14 that extends in a longitudinal direction of the pump casing. The pipe conduit 14 communicates with the intermediate space 11 defined between the second stage 8 and the third stage 9 via the check valve 13 and also with the intermediate space 10 defined between the first stage 7 and the second stage 8 via the check valve 12. The pipe conduit 14 has an end 14*a* that is bent to have a right angle to communicate with the first check valve 12. The pipe conduit 14 also has a short pipe 14*b* that is located at a longitudinal middle thereof to communicate with the second check valve 13.

The check valves 12 and 13 are secured each to an outer surface of the pump casing 2 and sealed by a sealing member. The check valves 12 and 13 communicate with the intermediate space 10 or 11 via a passage 35 or 36 of the pump casing 2. The check valves 12 and 13 allow a gas flow from the intermediate space 10 or 11 to the pipe conduit 14, while the check valves 12 and 13 prevent a gas flow from the pipe conduit 14 to the intermediate spaces 10 and 11. The check valves 12 and 13 open so as to flow out a gas from the intermediate space 10 or 11 when the pressure of the gas within the intermediate space 10 or 11 becomes more than a predetermined value (for example, an atmospheric pressure).

The intermediate space 10 is positioned between a fore end surface 29*b* of the helical tooth 29 of the first stage 7 and a rear end surface 30*a* of the helical tooth 30 of the second stage 8. The intermediate space 11 is positioned between a fore end surface 30*b* of the helical tooth 30 of the second stage 8 and a rear end surface 31*a* of the helical tooth 31 of the third stage 9. Each intermediate space 10 or 11 has a longitudinal length approximately equal to a half pitch of the helical tooth 30. In each intermediate space 10 or 11, there is received an intermediate shaft 38 having the same diameter as a root 37 of the screw rotors 3 and 4. Each of the shafts 19 and 20 has a diameter smaller than the intermediate shaft 38 or the root 37. The shafts 19 and 20 extend from a radial central part of the screw rotor 3 or 4. In a 180° opposite side of the passage 35 or 36 laterally contiguous with the intermediate space 10 or 11, there is defined a void 39 or 40 that is closed by a lid and sealed by a sealing piece.

The pair of screw rotors 3 and 4 have the screws directed oppositely to each other. The driving side clockwise helical screw rotor 3 has serially the smaller pitch helical tooth 31 of the third stage 9, the middle pitch helical tooth 30 of the second stage 8, and the larger pitch helical tooth 29 of the first stage 7. Meanwhile, the driven side counterclockwise helical screw rotor 4 has serially the larger pitch helical tooth 29 of the first stage 7, the middle pitch helical tooth 30 of the second stage 8, and the smaller pitch helical tooth 31 of the third stage 9. Each helical tooth 29 to 31 of the rotor 3 has the same shape as that of the rotor 4.

Figure 2:
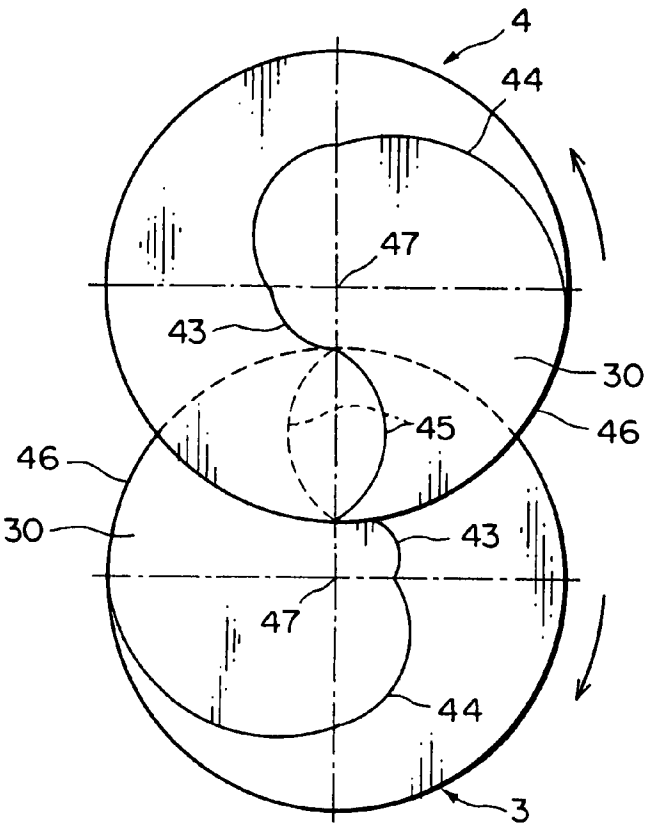
FIG. 2 is a cross sectional view showing profiles of a pair of screw rotors of the vacuum pump.

Referring to FIG. 2, cross section curves are provided, in which the pair of screw rotors 3 and 4 have engaged with each other. Each curve of helical teeth 29 to 31 (intermediate helical teeth 30 are illustrated in FIG. 2) consists of a quarter circular arc 43 having a smaller radius corresponding to the root 37, a pseudo-Archimedean spiral curve 44 contiguous with one end of the circular arc 43, an epitrochoid curve 45 contiguous with the other end of the circular arc 43, and a larger radius circular arc 46 corresponding to an outer periphery of the helical tooth. The Archimedean spiral curve 44 is smoothly contiguous with the circular arc 46, and the epitrochoid curve 45 is tangentially smoothly contiguous with the circular arc 46. In FIG. 2, reference numeral 47 designates a rotation center of each rotor.

The pair of screw rotors 3 and 4 rotate oppositely to each other in the casing 2 as shown by arrowheads. A gas moves by a distance in the casing 2 without compression. Then, the gas is compressed after an end surface of the rotor 4 closes the discharge port 6*a* (FIG. 1) defined in the partition wall 22 positioned near the side case 24. The compression continues during a half turn of the rotor 4 until the discharge port 6*a* opens to discharge the compressed gas. This operation is a known art and its detail is referred to Japanese Patent Application Laid-open No. 63-36085.

Next, the operation and theory of the vacuum pump will be discussed. In FIG. 1, the rotation of the pair of screw rotors 3 and 4 draws a gas from the suction port 5 of the casing 2 to compress the gas by the pair of helical teeth 29 of the first stage 7. The compressed gas moves to the second stage 8. The displacement capacity of the second stage 8 is smaller than that of the first stage 7. That is, a space defined by helical teeth 30 of the second stage 8 is smaller than that of the helical teeth 29 of the first stage 7. Thus, the gas is further compressed in the second stage 8. When the pressure of the compressed gas is larger than a predetermined discharge pressure, a part of the gas is discharged from the intermediate space 10 via the check valve 12 and the pipe conduit 14 while the remaining gas moves to the second stage 8.

A pressure Pm1 in the intermediate space 10, which is a pressure of the gas between the first stage 7 and the second stage 8, is obtained by the following equation:

$$Pm_1 = Ps_1 \times Qs_1 / Qs_2 \times Tm_1 / Ts_1 \quad (1)$$

where $Ps_1$: pressure of suction port 5

$Qs_1$: gas suction rate of first stage 7

$Qs_2$: gas suction rate of second stage 8

$Tm_1$: gas temperature between first stage 7 and second stage 8

$Ts_1$: gas temperature (absolute temperature) at suction port 5

Before Pm1 becomes a value obtained by the equation (1), the gas is partially discharged into the side of the discharge outlet 6 via the check valve 12 and the pipe conduit 14, and the remaining gas moves to the second stage 8. When Pm1 becomes equal to a value obtained by the equation (1), the check valve 12 closes so that all the gas drawn from the suction port 5 moves to the second stage 8.

Similarly to the first stage 7, a pressure $Pm_2$ in the intermediate space 11, which is a pressure of the gas between the second stage 8 and the third stage 9, is obtained by the following equation:

$$\begin{aligned} P_{m2} &= P_{m1} \times Q_{s2} / Q_{s3} \times T_{m2} / T_{s3} \quad (2) \\ &= P_{s1} \times Q_{s1} / Q_{s2} \times T_{m1} / T_{s1} \times Q_{s2} / Q_{s3} \times T_{m2} / T_{m1} = \\ &\quad P_{s1} \times Q_{s1} / Q_{s3} \times T_{m2} / T_{s1} \end{aligned}$$

where $Qs_3$: gas suction rate of third stage 9

$Tm_2$: gas temperature between second stage 8 and third stage 9

$Ps_1$, $Qs_1$, $Qs_2$, $Tm_1$, and $Ts_1$ are the same as those defined above.

Before $Pm_2$ becomes a value obtained by the equation (2), the gas is partially discharged into the side of the discharge outlet 6 via the check valve 13 and the pipe conduit 14, and the remaining gas moves to the third stage 9. When Pm2 becomes equal to a value obtained by the equation (2), the check valve 13 closes so that all the gas drawn into the second stage 8 moves to the third stage 9.

Figure 3:
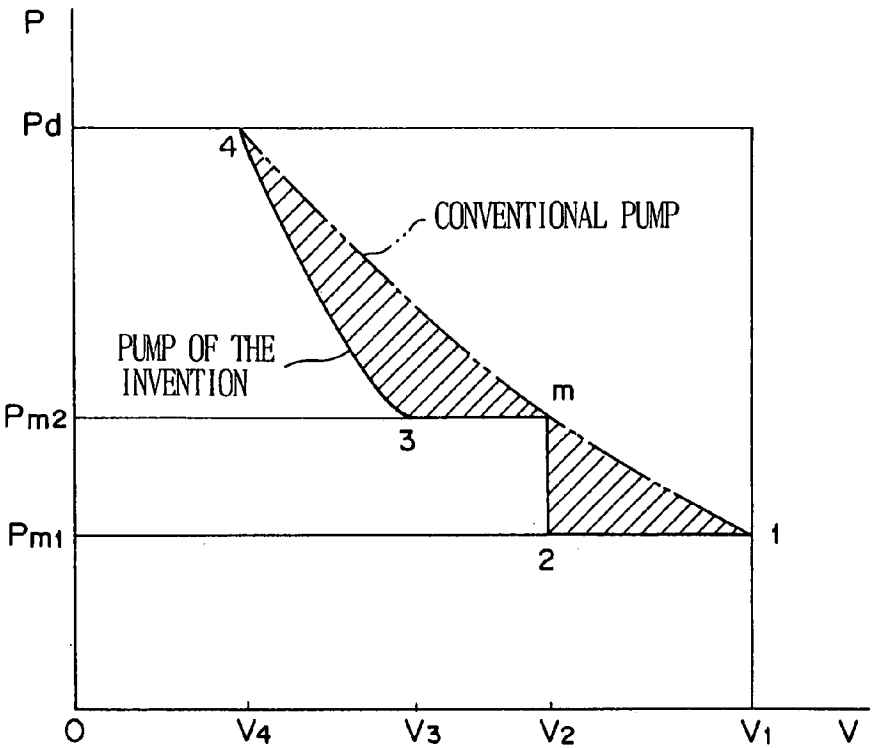
FIG. 3 is P-V curves each related to a work done of a screw vacuum pump of the present invention or a conventional screw vacuum pump.

FIG. 3 shows two P-V (work done) curves of vacuum pumps of the present invention and a conventional art in parallel. A P-V curve of a conventional pump consists of lines or curves serially connecting points 0, V1, 1, 4, and Pd. Meanwhile, A P-V curve of the vacuum pump 1 of the present invention consists of lines or curves serially connecting points 0, V1, 1, 2, m, 3, 4, and Pd.

In FIG. 3, P designates a pressure; V a specific volume; Pd a discharge pressure; Pm1 a pressure between the first stage 7 and the second stage 8 (of the intermediate space 10); Pm2 a pressure between the second stage 8 and the third stage 9 (of the intermediate space 11); $V_1$ a specific volume at a point of the suction side (compression initiating point); $V_2$ a specific volume at the intermediate space 10; $V_3$ a specific volume at the intermediate space 11; and $V_4$ a specific volume at a point of the discharge side.

The pressure of the conventional vacuum pump increases along a quadratic curve, which is approximately a line, from a suction side (numeral 1 of FIG. 3) to a discharge side (numeral 4 of FIG. 3). In the meantime, the vacuum pump 1 (FIG. 1) of the present invention partially discharges a gas into the pipe conduit 14 via the check valve 12 from the intermediate space 10 when the gas pressure of the chamber 32 at the first stage 7 becomes more than a predetermined pressure. Thus, the gas pressure ($Pm_1$) in the chamber 32 at the first stage 7 is constant from point 1 to point 2 (FIG. 3). Then, the gas in the chamber 33 at the second stage 8 is compressed up to $Pm_2$ as shown a line between point 2 and point m. The gas is partially discharged into the pipe conduit 14 via the check valve 13 from the intermediate space 11 when the gas pressure of the chamber 33 at the second stage 8 becomes more than another predetermined pressure. Next, the gas pressure ($Pm_2$) in the chamber 33 at the second stage 8 is constant from point m to point 3 (FIG. 3). Then, the gas in the chamber 34 at the third stage 9 is compressed along an approximately quadratic curve from point 3 to point 4 of FIG. 3.

Accordingly, the vacuum pump of the present invention saves a power (energy) by hatching areas of FIG. 3 as compared with the conventional vacuum pump.

When a suction side temperature Ts1 is 40° C. (313° K.), a discharge gas temperature tm1 at the first stage is obtained by the following equation:

$$t_{m1} = T_{s1} \times (P_{m1}/P_{s1})^{n-1/n} - 273$$
$$= 313 \times 1.4^{06/1.6} - 273 = 82(°C.)$$

where n: politropic exponent

The discharge gas temperature $tm_1$ of 82° C. at the first stage is less than 135° C. This fulfills the EN standard.

Similarly, a discharge gas temperature $tm_2$ at the second stage is obtained by the following equation:

$$t_{m2} = T_{s2} \times (P_{m2}/P_{m1})^{n-1/n} - 273$$
$$= (273 + 82) \times 1.4^{06/1.6} - 273 \fallingdotseq 130(°C.)$$

The discharge gas temperature $tm_2$ of 130° C. at the second stage is less than 135° C. This also fulfills the EN standard.

At the third stage, almost all the calorie generated can be used to increase a temperature of a cooling water in the jacket 18. Thus, a discharge gas temperature Td at the third stage is approximately equal to the discharge gas temperature $Tm_2$ at the second stage. Accordingly, all the gases discharged from the first and third stages are less than 135° C. to fulfill the EN standard.

Next, features of the vacuum pump 1 according to the present invention will be summarily discussed.

The conventional vacuum pump compresses a gas by two stages. However, an intermediate pressure between the first stage and the second stage exerts on the screw rotors, which requires an extra energy. To eliminate the disadvantage, the embodiment of the present invention employs the bypass pipe conduit 14 and the check valves 12, 13 to discharge partially the gas to keep the gas at a pressure not more than the predetermined pressure. This prevents a pressure more than the predetermined pressure from exerting on the screw rotors 3 and 4 between the first stage 7 and the second stage 8 or between the second stage 8 and third stage 9.

Each rotor has the helical tooth 29 of the first stage 7, the helical tooth 30 of the second stage 8, and the helical tooth 31 of the third stage 9 serially from the suction side. The discharge gas temperature (inside temperature) is determined to be less than 135° C. The gas is compressed at the first to third stages such that a ratio of a pressure of the finally discharged gas at the third stage to that at the suction side is determined to be 2.

$Pm_1$ designates a pressure between the first stage 7 and the second stage 8; $Pm_2$ a pressure between the second stage 8 and the third stage 9; Ps a suction pressure; Pd a discharge pressure; $Q_1$ a volume of the chamber 32 at the first stage 7; $Q_2$ a volume of the chamber 33 at the second stage 8; $T_1$ a temperature in the chamber 32; $T_2$ a temperature in the chamber 33; $R_1$ a ratio of a gas flow rate of the first stage 7 to the second stage 8; and $R_2$ a ratio of a gas flow rate of the second stage 8 to the third stage 9:

$$R_1 = Pm_1/Ps = Q_1/Q_2 \times T_2/T_1 \quad (3)$$

$$R_2 = Pm_2/Ps = Q_2/Q_3 \times T_3/T_2, \quad (4)$$

thus, $$R_1 \times R_2 = Pm_2/Ps = Q_1/Q_3 \times T_3/T_1 \approx Qth_1/Qth_3 \quad (5)$$

Actually, $R_1 \times R_2 = 2$, that is, $Qth_3$ is a half of $Qth_1$, where $Qth_1$: theoretical displacement volume of helical teeth 29 at first stage 7

$Qth_3$: theoretical displacement volume of helical teeth 31 at third stage 9, furthermore, $R_1 \times R_2 = R^2 = 2$, thus, $R_1 = R_2 = R = \sqrt{2} \approx 1.4$.

A ratio of a theoretical displacement volume of the first stage 7 to that of the second stage 8 is 1.4, and a ratio of a theoretical displacement volume of the second stage 8 to that of the third stage 9 is 1.4. That is, the theoretical displacement volume ratio of the first to third stages 7, 8, and 9 is 2:1.4:1.

Thus, a ratio of a gas flow rate of the first stage 7 to that of the second stage 8 is 1.4, and a ratio of a gas flow rate of the second stage 8 to that of the third stage 9 is 1.4. Accordingly, a ratio of a gas flow rate of the first stage 7 to that of the third stage 9 is approximately 2. The discharge port 6*a* (FIG. 1) is configured so as to open to discharge the gas at the third stage 9 after the gas is compressed into about a half in volume.

When a pressure ratio of Pd/Ps is 2 and Pd is 760 Torr (or 0.1 MPaA or 1 atm), Ps=Pd/2=380 Torr (or 0.05 MpaA), where Ps designates a discharge pressure and Ps designates a suction pressure.

Generally, a discharged gas temperature Td Ts $(Pd/Ps)^{n-1/n}$ where n (politropic exponent)=1.6

$$Td = 293 \times 2^{0.375} \approx 106(° C.)$$

This temperature of 106° C. is lower than 135° C., fulfilling the EN standard.

The discharged gas temperature may be lower than 135° C. based on a thermal conversion calculation when the gas pressure in the suction side is about 380 Torr. When the vacuum pump operates with the suction side of the pump being closed, a cooling gas is introduced into a discharge side of the pump to cool its inside. The cooling gas is supplied from a port (not shown) defined in an inner surface of the casing into the casing, the port being opened and closed by the movement of the helical tooth. This cooling method is referred to Japanese Patent Application Laid-open No. 63-36085.

Figure 4:
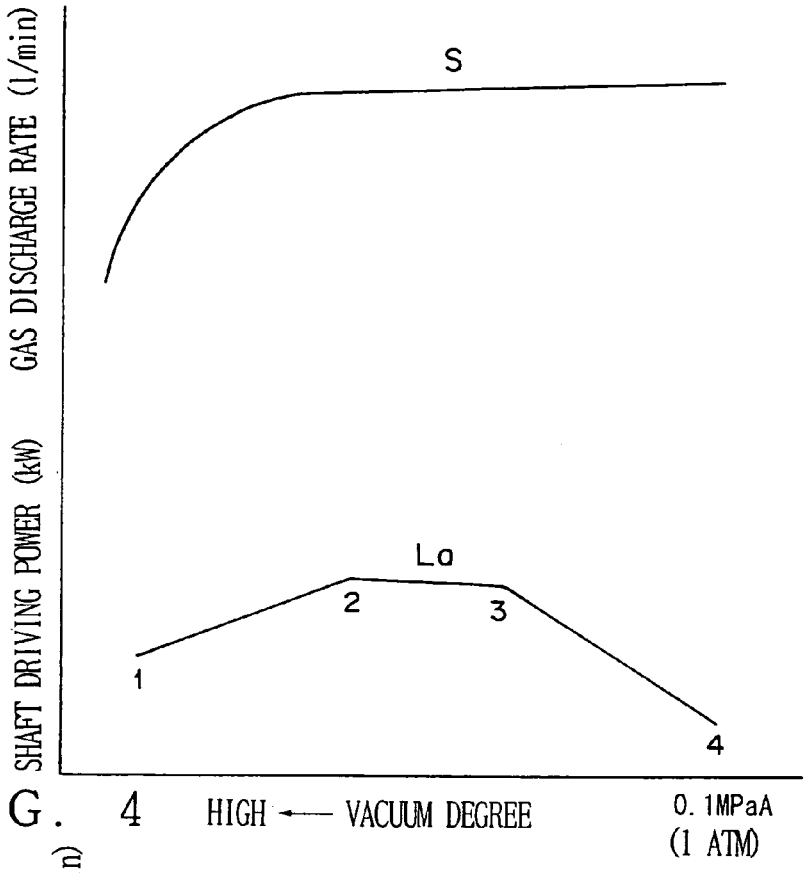
FIG. 4 is characteristic curves of a gas discharge rate and a shaft driving power of the screw vacuum pump of the present invention.
Figure 6:
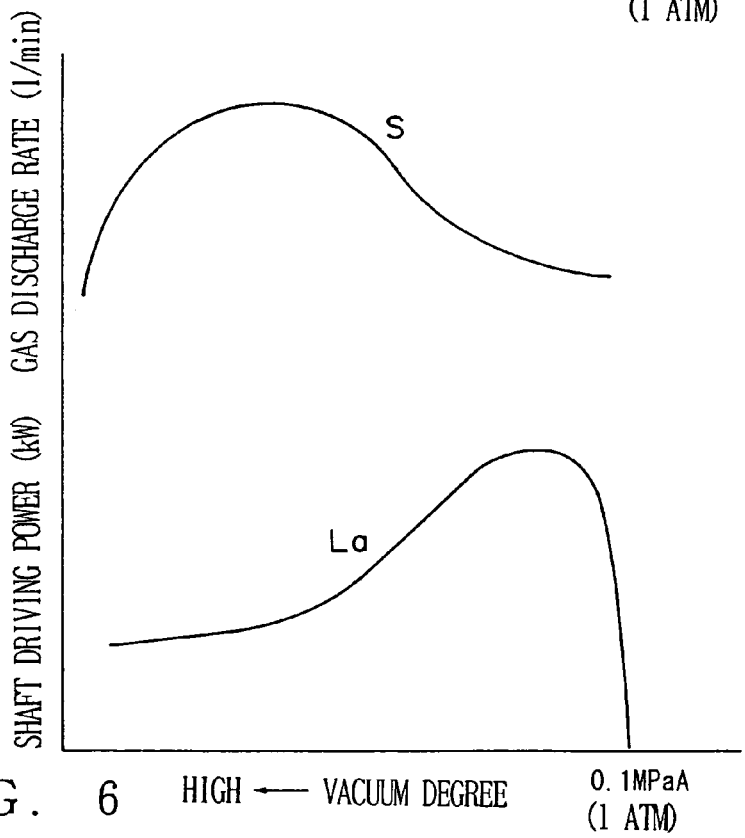
FIG. 6 is characteristic curves of a gas discharge rate and a shaft driving power of the conventional screw pump.
Figure 5:
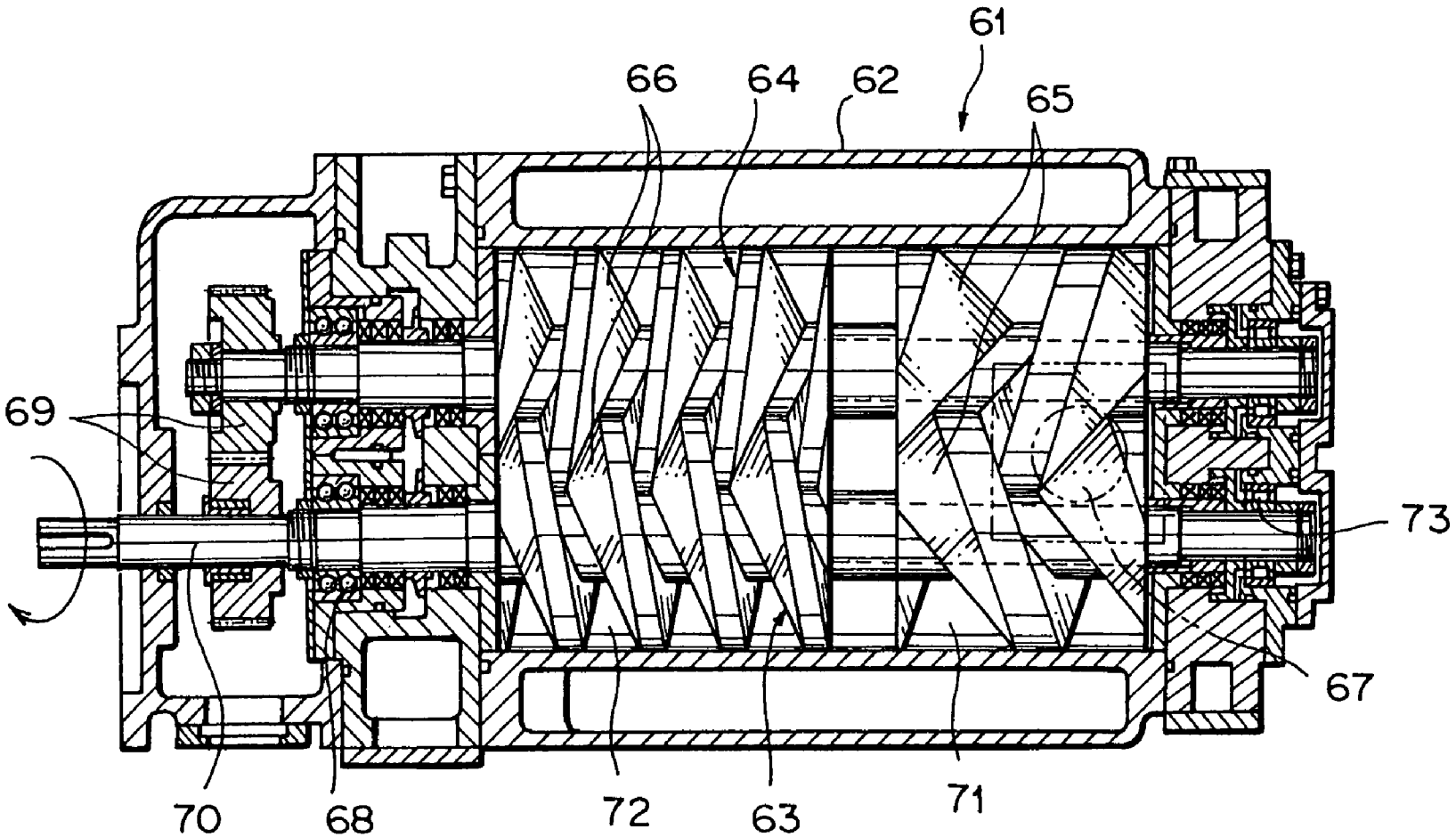
FIG. 5 is a longitudinal sectional view showing a conventional screw vacuum pump.

As illustrated in a characteristic curve of FIG. 4, the vacuum pump according to the present invention requires a discharging time considerably less than that (FIG. 6) of the conventional pump, achieving an energy saved pump. In FIG. 4, a lower graph shows a shaft driving power La (kW), and an upper graph shows a discharge gas flow rate S (1/minute). Lateral coordinates correspond to vacuum degrees (MPaA).

In FIG. 4, a shaft driving power La ranged from point 1 and point 2 corresponds to one for compressing the gas by the helical teeth 29 at the first stage 7. A shaft driving power La ranged from point 2 and point 3 corresponds to one for compressing the gas by the helical teeth 30 at the second stage 8. A shaft driving power La ranged from point 3 and point 4 corresponds to one for compressing the gas by the helical teeth 31 at the third stage 9. Unlike the conventional pump, the pipe conduit 14 partially discharges the gas so that the shaft driving power of the second stage 8 is kept in a lower range. The shaft driving power graph is generally a trapezoid with an upper flat line as a whole.

Furthermore, as shown in the discharge gas flow rate curve of the upper graph of FIG. 4, the provision of the pipe conduit 14 enables that a discharge gas rate obtained the helical teeth 29 at the first stage 7 is kept until the gas is compressed up to the predetermined pressure at the third stage 9. The displacement capacity does not decease in the discharge side unlike the conventional pump (the upper graph of FIG. 6). This considerably decreases a time for discharging the gas to allow an efficient pump operation particularly when the gas is discharged under an atmospheric pressure.

The vacuum pump 1 (FIG. 1) may be modified to be another embodiment that has a pair of upper and lower screw rotors in place of the left and right screw rotors 3, 4. The screw rotors 3, 4 may have helical teeth of the three stages which are separately formed to be assembled in one body. The timing gears 28 may be positioned not in the discharge side but in the suction side. The concept that the gas is compressed at the three stages 7 to 9 may be applied to another vacuum pump having screw rotors using a gear profile different from the one of FIG. 2. Air may be selected as the gas.

INDUSTRIAL APPLICABILITY OF THE INVENTION

As mentioned above, according to the present invention of claim 1, the provision of the three types of helical teeth, the bypass conduit, and the check valves protects the screw rotors not to be under a larger load otherwise exerted during the first to third stages. This enables a reduced shaft driving power to be better in energy saving, contributing a deduction of $CO_2$ emission in a heat power plant. The pump casing keeps a comparatively lower inner pressure unlike the conventional art, limiting a temperature increase of the delivered gas. Thereby, the vacuum pump can be used more safely, for example, as a chemical vacuum pump. Furthermore, the gas discharge rate at the first stage 7 is kept until the gas is finally discharged, considerably decreasing a time taken for discharging the gas to allow an efficient pump operation, particularly when the gas is discharged under an atmospheric pressure.

The invention of claim 2 limits a temperature increase of the delivered gas, fulfilling the EN temperature standard for a chemical vacuum pump. This prevents a danger such as inflammation of the chemical gas, improving the pump in safety.

The invention of claim 3 determines the gas flow rates of the first to third stages to surely have the advantageous effects of the inventions of claims 1 and 2.

What is claimed is:

1. A screw vacuum pump having a pair of screw rotors rotatively engaged with each other in a pump casing to discharge a gas along a longitudinal direction of the pump, each rotor having a cross section with a profile including an epitrochoid curve, a circular arc, and a pseudo-Archimedean spiral curve, wherein the pump is characterized in that:

each rotor of the pair of screw rotors has a first, a second, and a third set of helical teeth, which are serially located in a longitudinal direction of each rotor, are different from each other in theoretical displacement volume, and are different from each other in type;

wherein the first helical teeth of each rotor are positioned on a suction side, the third helical teeth of each rotor are located on a discharge side, and the second helical teeth of each rotor are located intermediate to the suction and discharge side; and a bypass conduit communicates with a delivery side of the pump, is connected via a first check valve to a first intermediate space defined between the first helical teeth and the second helical teeth, and is connected via a second check valve to a second intermediate space defined between the second helical teeth and the third helical teeth.

2. The screw vacuum pump according to claim 1 wherein the pump is characterized in that the three types of helical teeth provide a ratio of 1.4 of a gas flow rate at the first stage to that at the second stage, a ratio of 1.4 of a gas flow rate at the second stage to that at the third stage, and a ratio of 2 of a gas flow rate at the first stage to that at the third stage.

3. The screw vacuum pump according to claim 1 or 2 wherein the pump is characterized in that the gas is compressed at the third stage into half of the first stage volume before a discharge port opens to discharge the gas.

4. The screw vacuum pump according to claim 1, wherein each of the first and second intermediate spaces have a longitudinal length equal to one-half of a pitch of the first helical teeth.

5. The screw vacuum pump according to claim 1, wherein a pair of intermediate shafts is disposed in each of the first and second intermediate spaces; and wherein each intermediate shaft has a diameter equal to a root of each rotor.

6. A screw vacuum pump, comprising:

a pump casing;

a pair of screw rotors rotatively engaged with each other in the pump casing to discharge a gas along a longitudinal direction of the pump, each rotor having a cross section with a profile including an epitrochoid curve, a circular arc, and a pseudo-Archimedean spiral curve, each rotor having a first, a second, and a third set of helical teeth, the sets of teeth being serially located in a longitudinal direction of each rotor, the sets of teeth being different from each other in theoretical displacement volume, and the sets of teeth being different from each other in type;

parallel rotor chambers accommodating left and right screw rotors, respectively the first helical teeth of each rotor being positioned on a suction side, the third helical teeth of each rotor being located on a discharge side, and the second helical teeth of each rotor being located intermediate to the suction and discharge side;

a bypass conduit communicating with a delivery side of the pump;

a first check valve connecting the bypass conduit to a first intermediate space defined between the first helical teeth and the second helical teeth; and a second check valve connecting the bypass conduit to a second intermediate space defined between the second helical teeth and the third helical teeth.

7. The screw pump according claim 6, wherein the first helical teeth of the pair of rotors form a first stage, the second helical teeth of the pair of rotors form a second stage, and the third helical teeth of the pair of rotors form a third stage.

8. The screw vacuum pump according to claim 7, wherein the three types of helical teeth provide a ratio of 1.4 of a gas flow rate at the first stage to that at the second stage, a ratio of 1.4 of a gas flow rate at the second stage to that at the third stage, and a ratio of 2 of a gas flow rate at the first stage to that at the third stage.

9. The screw vacuum pump according to claim 8 wherein the gas is compressed at the third stage into half of the first stage volume before a discharge port opens to discharge the gas.

10. The screw vacuum pump according to claim 6, wherein each of the first and second intermediate spaces have a longitudinal length equal to one-half of a pitch of the first helical teeth.

11. The screw vacuum pump according to claim 6, wherein a pair of intermediate shafts is disposed in each of the first and second intermediate spaces; and wherein each intermediate shaft has a diameter equal to a root of each rotor.

12. The screw vacuum pump according to claim 6, wherein each rotor has a helical screw pitch in the first stage which is larger than a screw pitch in the third stage.

13. The screw vacuum pump according to claim 6, wherein a rotor chamber of the first stage has a longitudinal length equal to or greater than a longitudinal length of a rotor chamber of the second stage.

14. The screw vacuum pump according to claim 6, wherein a rotor chamber of the third stage has a longitudinal length less than a longitudinal length of a rotor chamber of the second stage.

* * * * *